US006018966A

United States Patent [19]

Shima

[11] Patent Number: 6,018,966

[45] Date of Patent: Feb. 1, 2000

[54] STITCH FORMING METHOD AND A FLAT KNITTING MACHINE THEREFOR

[75] Inventor: Masahiro Shima, Wakayama, Japan

[73] Assignee: Shima Seiki Manufacturing, Ltd., Wakayama, Japan

[21] Appl. No.: 09/114,488

[22] Filed: Jul. 13, 1998

[30] Foreign Application Priority Data

Jul. 11, 1997 [JP] Japan ..... 9-202462

[51] Int. Cl.[7] ..... D04B 7/00

[52] U.S. Cl. ..... 66/75.1; 66/64; 66/77

[58] Field of Search ..... 66/60 R, 64, 70, 66/71, 75.1, 76, 77, 78, 96 R, 120, 148

[56] References Cited

U.S. PATENT DOCUMENTS

| | | | |
|---|---|---|---|
| 4,012,927 | 3/1977 | Kuhnert | 66/78 |
| 4,474,037 | 10/1984 | Kuhnert . | |
| 4,637,228 | 1/1987 | Shima | 66/75.1 |
| 4,643,003 | 2/1987 | Schmodde | 66/78 |
| 4,905,483 | 3/1990 | Shima | 66/64 |
| 5,343,719 | 9/1994 | Nakamori et al. | 66/78 |
| 5,367,892 | 11/1994 | Shima et al. | 66/78 |
| 5,398,527 | 3/1995 | Hirai et al. | 66/64 |
| 5,557,948 | 9/1996 | Shima et al. | 66/64 |

*Primary Examiner*—John J. Calvert
*Assistant Examiner*—Larry D. Worrell, Jr.
*Attorney, Agent, or Firm*—Nikaido, Marmelstein, Murray & Oram LLP

[57] ABSTRACT

When a new yarn is received by a hook to form a new stitch loop, to prevent old stitch loops from going beyond the top end of the slider and being knocked over, the advanced position of the slider into the trick gap is maintained, and the new stitch loops are pulled into the old stitch loops. Next, the hook of a compound needle of the opposing needle bed is inserted into the old stitch loop, and said slider is lowered and retracted, and at the same time, the old stitch loops are transferred onto the hooks of the opposing needle bed to make split knit.

9 Claims, 15 Drawing Sheets

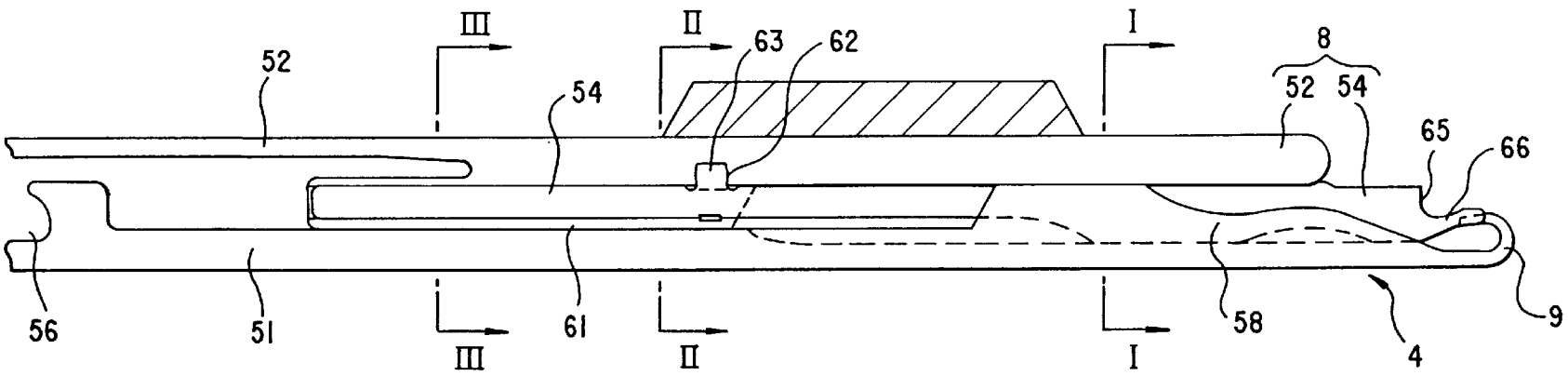
FIG.3-A
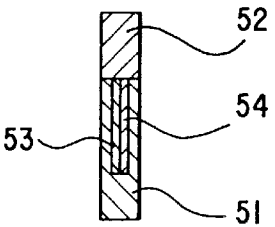
FIG.3-B
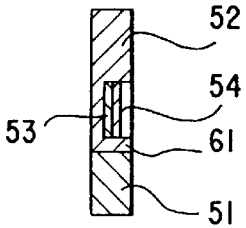
FIG.3-C
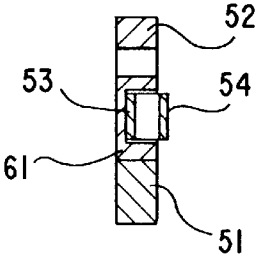
FIG.3-D

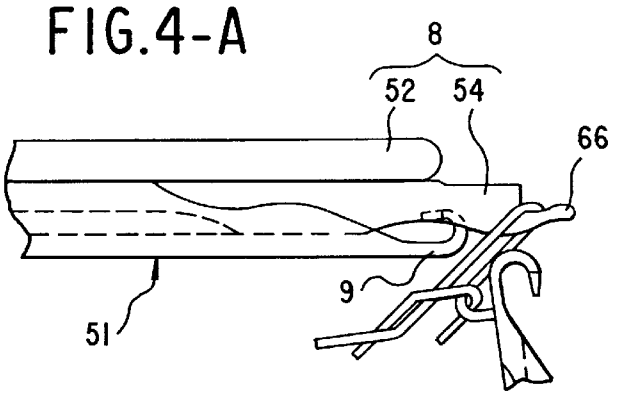
FIG.4-A
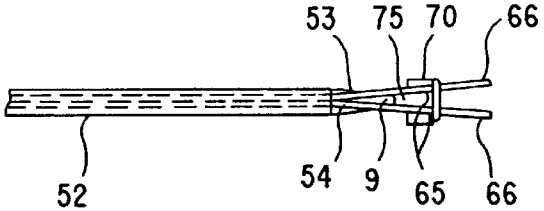
FIG.4-B
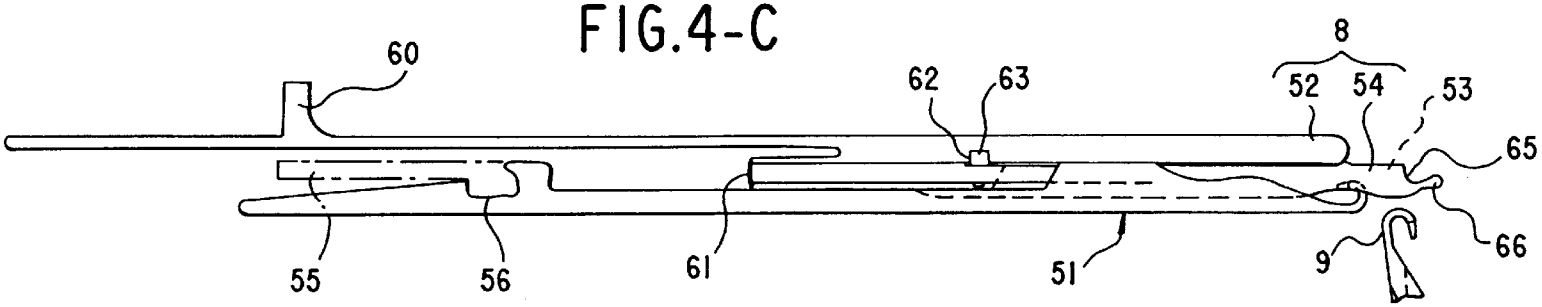
FIG.4-C
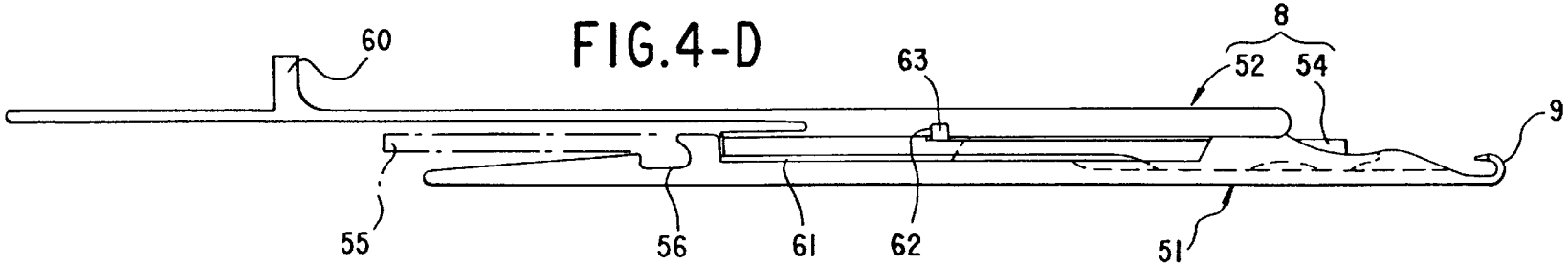
FIG.4-D

FIG. 8 ④
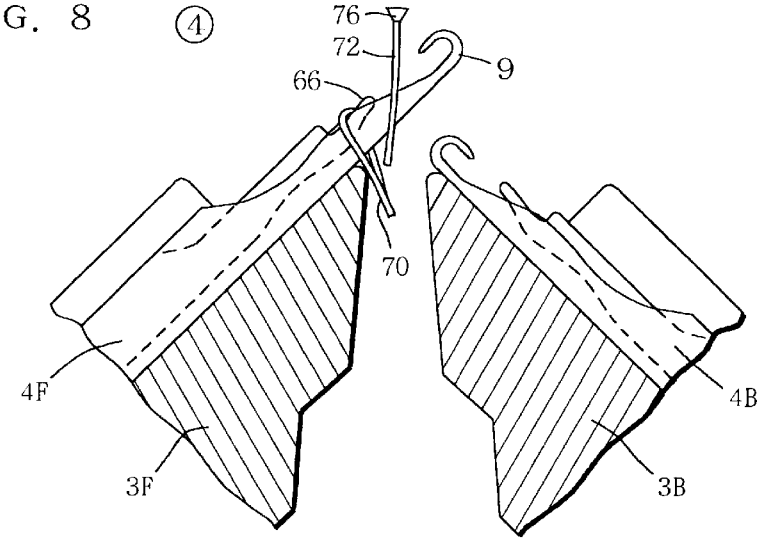
FIG. 9 ⑤
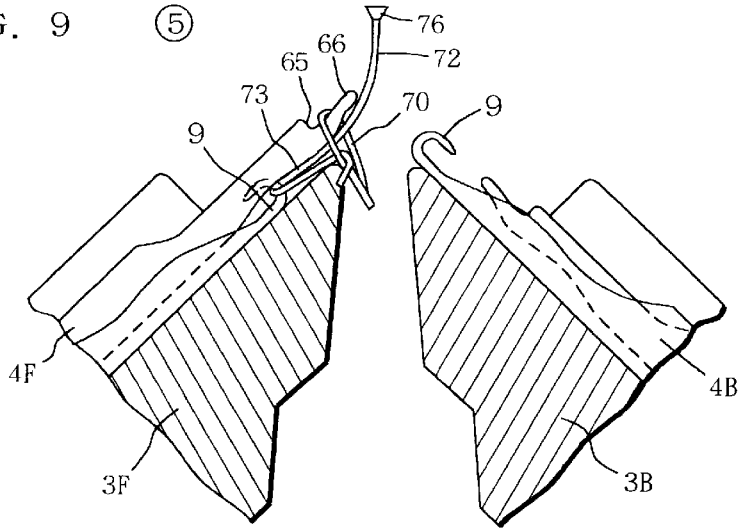
FIG. 10 ⑥
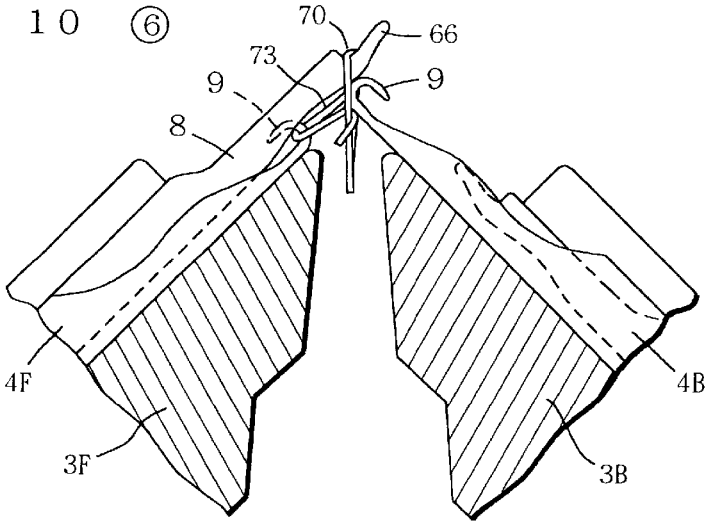

78

FIG. 31-A
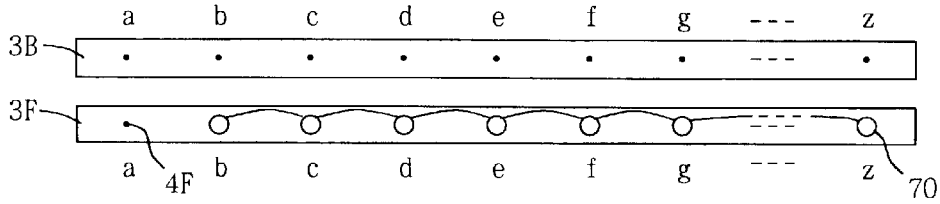
FIG. 31-B
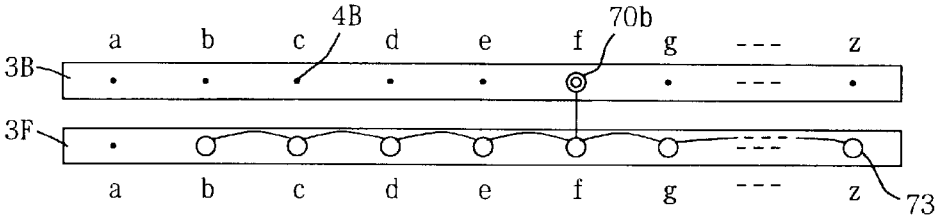
FIG. 31-C
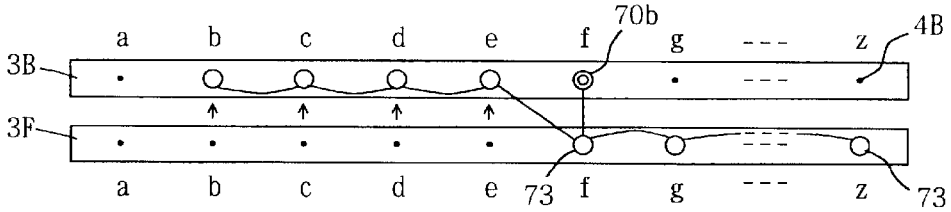
FIG. 31-D
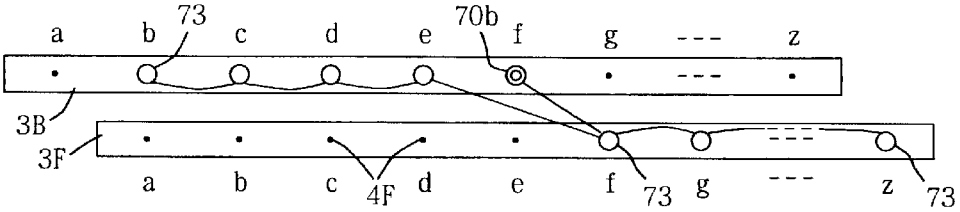
FIG. 31-E
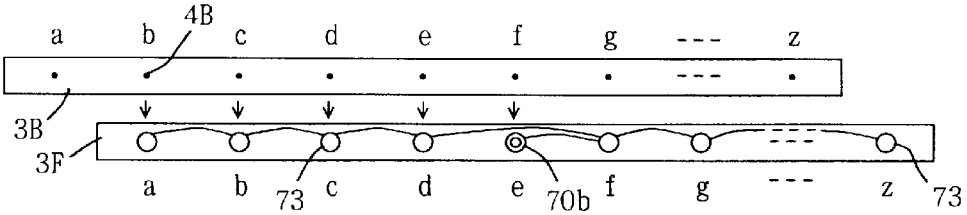
FIG. 31-F
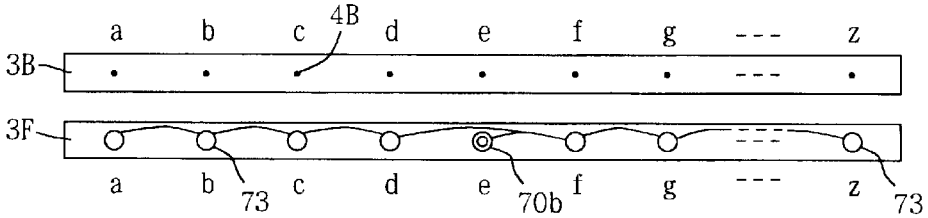

STITCH FORMING METHOD AND A FLAT KNITTING MACHINE THEREFOR

FIELD OF THE INVENTION

The present invention relates to a stitch forming method for new split knit, plating and pile knitting, etc. with a flat knitting machine that is provided with a row of compound needles wherein a hook of a needle proper is slidably pinched by two elastic plates having a tongue at the top end thereof and the hook can be opened and closed by said tongues, and to an apparatus therefor.

PRIOR ART

In the past, when an operation for increasing the number of stitches in the middle of a course, such as split knit, is made, needles, each having a wing or a dent on the side of the needle shank, are inserted in one needle bed of a pair of needle beds opposing head to head, and these inserted needles are used, in split knit, as needles that deliver loops. A needle of the opposing bed, on the splitting side, is inserted between a wing and a shank or in a recess, then a loop being held on a needle on the delivering side will be held on the hook of the needle on the splitting side, at the same time, a yarn will be received on the hook of the needle on the delivering side. Then both needles are pulled down to increase the loops in one course by one. However, as this means inserts the needle on the splitting side into the wing on the side of the needle, the newly formed loop is pulled out in a twisted condition.

In the case of split knit with latch needles, as the current loop is pulled in after the delivery of the old loop, friction will be generated between the old loop and the new loop, posing some problems such as yarn breakage and irregular stitches.

SUMMARY OF THE INVENTION

The object of the present invention is to provide various new knitting methods by using a slider that is advanced beyond the hook over the trick gap so as to prevent an old loop from slipping off the top end of the slider and being knocked over when the needle holding the old loop on the hook thereof is advanced to the trick gap to pull in the yarn fed and then the needle is retracted. To be more specific, the present invention provides new knitting methods for split knit, plating, pile knitting, etc.

In this specification, knock over means removal of an old loop from a compound needle by retracting a hook or a slider thereof.

The stitch forming method according to the present invention uses a flat knitting machine wherein at least a pair of needle beds, one in a front and an other in a rear, are provided, an area between said needle beds constitutes a trick gap, and each of the needle beds is provided with a plurality of compound needles, each comprising a needle proper having a hook at a top end thereof and a slider having two elastic plates each having a tongue at a top end thereof, in said compound needle, the needle proper and the slider are individually slidable forward to and backward from the trick gap, the tongues are to open and close the hook, and with advancement of the tongues beyond the hook, said two elastic plates are opened by said hook, and a yarn feeder is provided to feed yarn to the hook of said compound needle, said stitch forming method comprising:

a: a step for advancing, to the trick gap, a hook and tongues of a first compound needle of a first needle bed, said first compound needle holding at least one first stitch loop; and b: a step for feeding a first yarn from the yarn feeder to the hook of the first compound needle, retracting said hook for holding said first yarn on the hook, and keeping said tongues in the trick gap for holding said first stitch loop on said tongues without knocking over the first stitch loop from the first compound needle.

Preferably, said step b is followed by c: a step for keeping said tongues in the trick gap and retracting further the hook of said first compound needle, forming at least a second stitch loop and holding the second stitch loop on the hook of the first compound needle.

Preferably, said step b is followed by c: a step for keeping said tongues in the trick gap and retracting further the hook of said first compound needle, forming at least a second stitch loop and holding the second stitch loop on the hook of the first compound needle;

d: a step for advancing the tongues of the first compound needle to such a position that a hook of a second compound needle of the second needle bed of said pair of needle beds can enter into said first stitch loop;

e: a step for advancing the hook of the second compound needle and inserting the hook into the first stitch loop being held on the tongues of the first compound needle; and f: a step for retracting the tongues of the first compound needle to hold said first stitch loop on the hook of the second compound needle.

Preferably, at least on one side of said pair of front and back needle beds is provided a transfer jack bed having a plurality of transfer jacks are arranged, and said step b is followed by c: a step for keeping said tongues in the trick gap and retracting further the hook of said first compound needle, forming at least a second stitch loop and holding the second stitch loop on the hook of the first compound needle;

g: a step for advancing the tongue of the first compound needle to such a position that a transfer jack of the transfer jack bed can enter into said first stitch loop;

h: a step for advancing said transfer jack and inserting said transfer jack into the first stitch loop being held on the tongues of the first compound needle; and i: a step for retracting the tongues of the first compound needle to hold said first stitch loop on said transfer jack.

Preferably, said step b is followed by j: a step for advancing again the hook of said first compound needle;

k: a step for feeding a second yarn from a yarn feeder to the hook of the first compound needle, retracting said hook and pulling said second yarn into the first stitch loop to align the first yarn and the second yarn and hold them on the hook of the first compound needle; and c: a step for keeping said tongues in the trick gap and retracting further the hook of said first compound needle, forming at least a second stitch loop and holding the second stitch loop on the hook of the first compound needle.

Preferably, said step b is followed by l: a step for advancing the hook of said first compound needle and a hook of a second compound needle of the second needle bed of said pair of needle beds;

m: a step for feeding a second yarn from a yarn feeder to the hook of the first compound needle and the hook of the second compound needle, retracting the hook of said first compound needle, puling said second yarn into the first stitch loop to align the first yarn and the second yarn and hold them on the hook of said first compound needle, retracting the hook of said second compound needle to hold the second yarn on the hook of said second compound needle;

c: a step for holding said tongues in the trick gap and retracting further the hook of said first compound needle, forming at least a second stitch loop and holding the second stitch loop on the hook of the first compound needle; and n: a step for advancing the hook of said second compound needle, then, advancing the tongues of said second compound needle, holding said second yarn on the tongues, then, retracting the hook and tongues of the second compound needle to remove the second yarn from the second compound needle.

In the flat knitting machine of the present invention comprising:

at least a pair of needle beds, one in a front and an other in a rear;

a trick gap between said needle beds;

a plurality of compound needles, each comprising a needle proper having a hook at a top end thereof and a slider having two elastic plates each having a tongue at a top end thereof, wherein each needle proper and each slider are individually slidable in the needle beds forward to and backward from the trick gap, each needle proper is provided with a needle proper butt, each slider is provided with a slider butt, the tongues are to open and close the hooks, and with the advancement of the tongue beyond the hook, said two elastic plates are opened by said book;

at least a yarn feeder for feeding a yarn to the hooks; and a carriage having a knitting lock comprising a needle cam lock and a slider cam lock provided on the trick gap side of the needle cam lock and working on slider butts for advancing and retracting the sliders, wherein said needle cam lock comprises a raising cam working on the needle proper butts for advancing hooks to the trick gap; and knitting cams arranged on both sides of the raising cam for retracting the hooks, and wherein said slider cam lock is provided with a first slider butt track engaging with the slider butts for keeping the tongues in a position beyond the hooks and making the slider butts pass through the knitting lock so that loops on the sliders are not knocked over during retracting the hooks from the trick gap and said slider cam lock guides said slider butts into a subsequent knitting lock.

Preferably, said carriage is provided with at least two of said knitting locks for each of said pair of front and back needle beds.

Preferably, between said knitting locks, is provided a second slider butt track for advancing tongues holding a stitch loop to such a position that the hook of a compound needle of the needle bed opposing to said tongues can be inserted into said stitch loop.

In the stitch knitting method according to the present invention, when a needle holding a stitch loop on the hook thereof advances into the trick gap, receives a yarn and retracts, the slider is made to advance beyond the hook into the trick gap so as to prevent the old loop from moving beyond the top end of the slider and being knocked off. When the slider is kept in this state and the slider is guided into a subsequent knitting means such as a knitting lock, required knitting operations can be made in the subsequent knitting block. As a result, the stitch knitting method of the present invention enables new stitch formation, such as split knit, plating and pile knitting.

In the present invention, when a needle rises to catch a yarn for forming a new loop with the hook thereof and to put the yarn through an old loop, the old loop is held at a position of a specified height by the tongues of the slider. As a result, the new loop does not make any heavy contact with the old loop, and the new loop is formed without any frictions, resistances, etc. between the old loop and the new loop. Hence the new loops are free of any twist in a direction caused by said frictions and are symmetrical and their centers are aligned.

Since new loops are not subjected to any frictions or resistances, when a large number of split knit loops are formed in the same course, generation of strain in the direction of wale of the fabric, which is usual in the prior art, is presented. In the case of plating, the overlappings of loops on the face and on the back are regular, and appearance of the opposite color on the face or on the back does not occur. In the case of pile knitting, pile loops can be formed regularly.

BRIEF DESCRIPTION OF THE ATTACHED DRAWINGS

FIGS. 1A, B, C shows a compound needle and the cam arrangement of a flat knitting machine used in an embodiment.

FIG. 1-A is a layout diagram showing cam locks, seen from below, arranged on the carriage in the front and in the back.

FIG. 1-B is a side view of the compound needle including a needle jack and a selector.

FIG. 1-C is a side view showing the state of the compound needle when the selector jack butt is pushed in by a split knit presser.

FIG. 2 is a perspective view showing the compound needle disassembled.

FIGS. 3A, B, C, D shows the compound needle inserted in a needle groove. FIG. 3-A is an enlarged side view of the head of the compound needle. FIG. 3-B, FIG. 3-C and FIG. 3-D are sectional views along the lines I—I, II—II, and III—III of FIG. 3-A.

FIGS 4A, B, C, D shows the compound needle that is used in the embodiment.

FIG. 4-A is an enlarged side view showing head of the compound needle when a slider holding a loop on the tongues thereof rises and the hook of a needle of the opposing needle bed enters into the loop.

FIG. 4-B is a plan view when the slider rises above the hook and the loop is held on the tongues of the slider separated from each other by the hook.

FIG. 4-C is a side view of the compound needle, showing the state of the slider when it rises above the hook.

FIG. 4-D is a side view of the compound needle, showing the state when the slider is pushed by the needle proper to rise.

FIG. 8 is a sectional view in part of the front and back needle beds illustrating the motion of the needles in split knit, showing the state when the hook of the needle of the front bed descends to a tuck position to receive a new yarn.

FIG. 9 is a sectional view in part of the front and back needle beds illustrating the motion of the needles in split knit, showing the state when the hook of the needle of the front bed pulls a new loop of the new yarn into the loop to be split.

FIG. 10 is a sectional view in part of the front and back needle beds illustrating the motion of the needles in split knit, showing the state when the hook of the needle of the back bed enters into the loop to be split.

FIGS. 31A, B, C, D, E, F. FIGS. 31A through F are diagrams showing, in the order of knitting steps, the positional relationship of the front and back needle beds, needles and loops being held on these needles in split knit.

Figure 32:
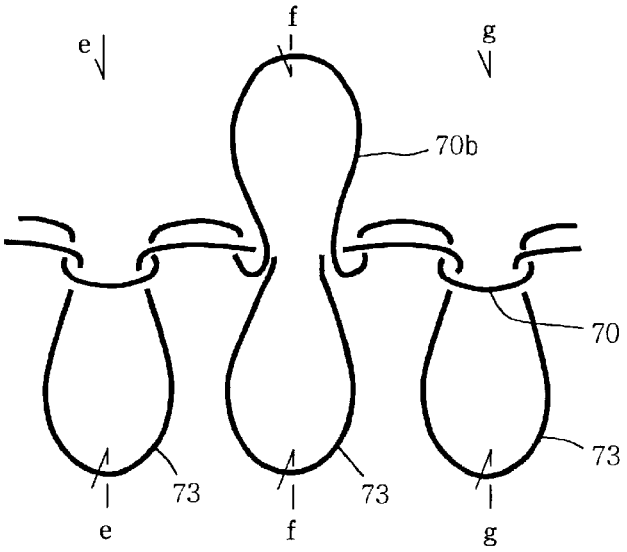

FIG. 32 is a diagram showing the relationship of the needles of the front and back needle beds and split knit loops.

Figure 1:
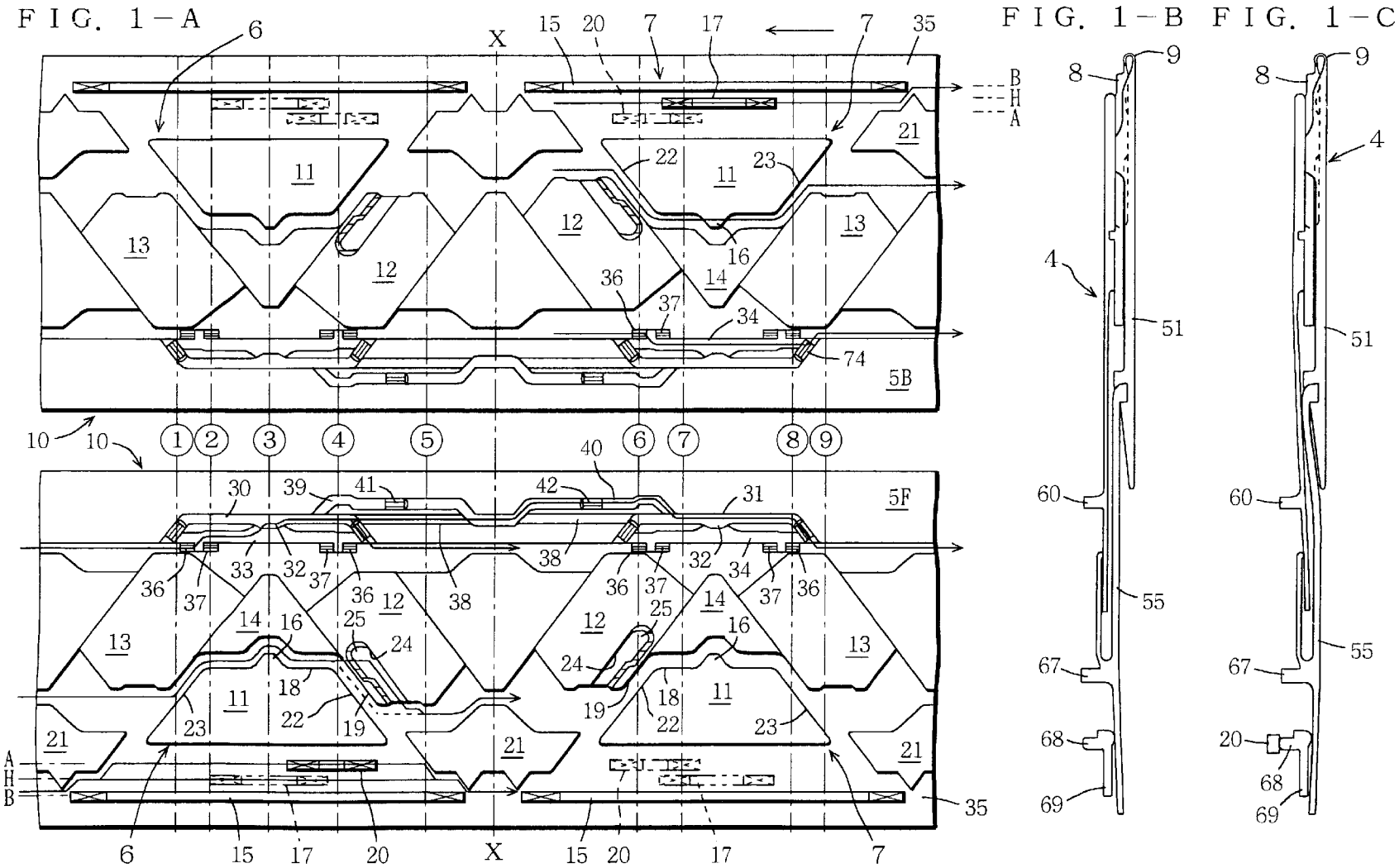
Figure 33:
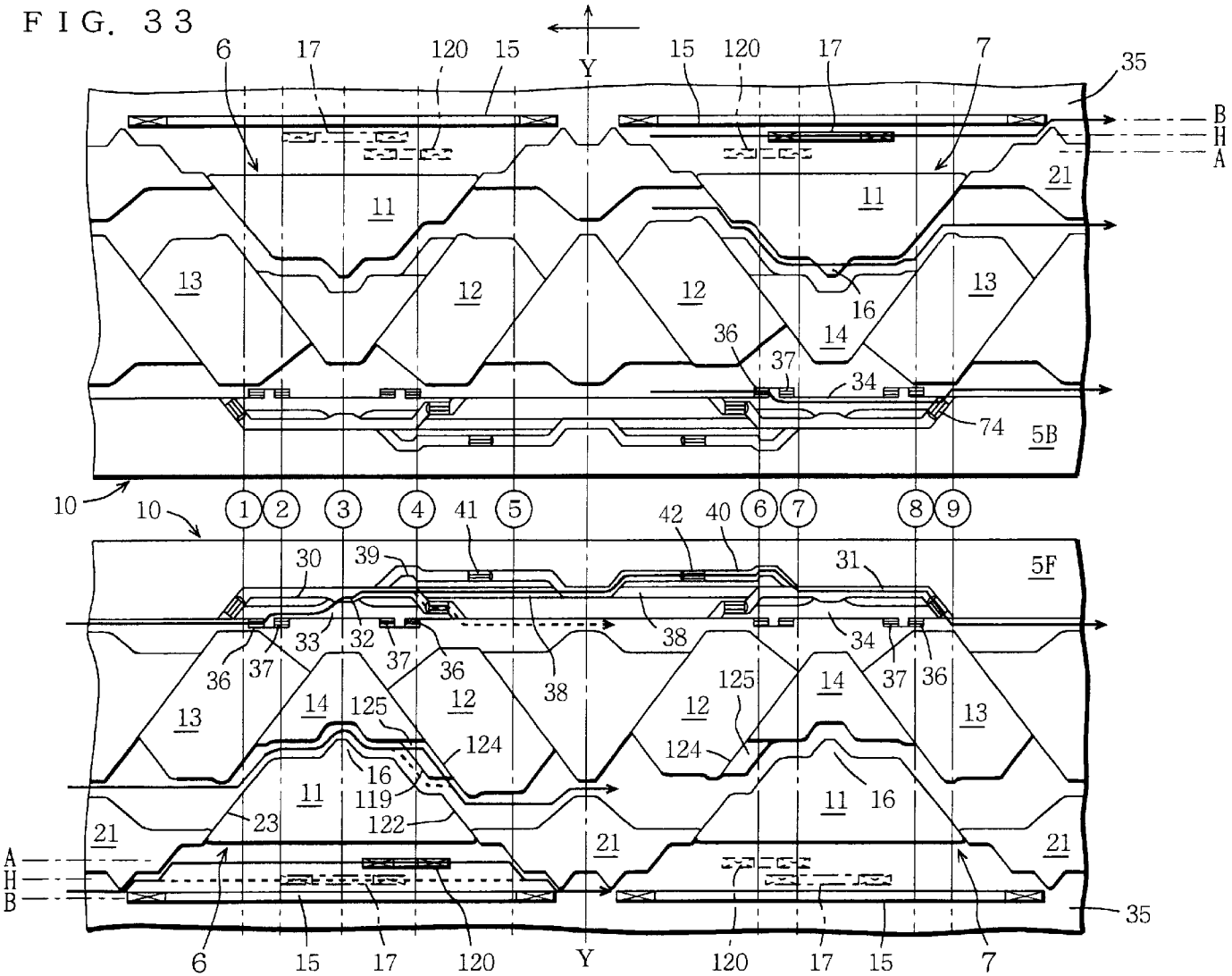

FIG. 33 shows a modification of cams of FIG. 1-A.

Embodiment

An embodiment of the stitch forming method according to the present invention and the apparatus for implementing said method will be described with reference to attached diagrams.

Figure 5:
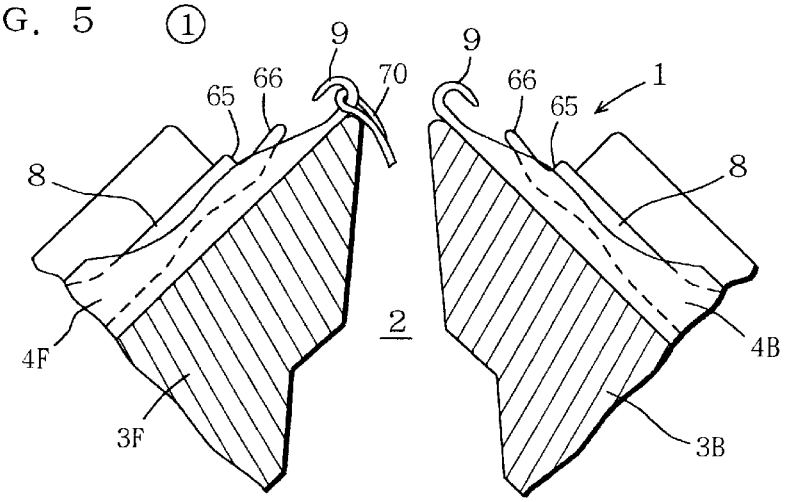
FIG. 5 is a sectional view in part of the front and back needle beds illustrating the motion of needles in split knit when a loop to be split is held on the hook of a needle of the front bed.

A flat knitting machine to be used for implementing the method according to the present invention is, as shown in FIG. 5, a flat knitting machine wherein compound needles 4 are inserted in parallel with each other in a pair of needle beds 3F, 3B opposing to each other, head to head, with a trick gap 2 in between them. FIG. 1-A shows the lower faces of the cam locks for controlling the compound needles 4, the cam locks being arranged on the front and back carriages 5F, 5B. FIG. 1-B shows the side of the compound needle 4 that is controlled by the cam lock. FIG. 1-C shows the state of the compound needle 4 when the compound needle 4 is pushed into a needle groove by a split knit presser cam that will be described later.

As the cam arrangement of the front and back carriages 5F, 5B is symmetrical, the front carriage 5F will be described in detail.

On the front carriage 5F, are arranged needle cam locks 6, 7 for raising and lowering the compound needle 4 and a slider cam lock 10 for raising and lowering the slider 8 of the compound needle 4 and opening and closing the hook 9 of the compound needle 4. As the needle cam locks 6,7 are arranged symmetrical about the center line X of the carriage 5F, the needle cam lock 6 will be described, and identical marks will be given to the needle cam lock 7 and its description will be omitted.

The needle cam lock 6 is provided with, at the center thereof, a raising cam 11 for raising the compound needle 4 to the knit position. Knitting cams 12, 13 for lowering the compound needle 4 are arranged on both sides of the raising cam 11, and a guide cam 14 is arranged above the raising cam 11. Below the raising cam 11, are arranged a fixed presser for suspension 15, longer than the length of the base of the raising cam 11, a tuck presser 17, longer than the width of a protrusion 16 at the center of the raising cam 11, and a split knit presser 20. The splitknit presser 20 has a length that extends from the raising cam 11's shoulder 18 that is close to the knitting cam 12 to a down slope 19 of the knitting cam 12. Both the tuck presser 17 and the split knit presser 20 are supported on a carriage base 35 in such a way that they can protrude from the base 35 or retract into the base 35 as desired. On both sides of the raising cams 11, 11, are arranged select jack guide cams 21.

The knitting cams 12, 13 are supported in such a way that they can rise or descend in parallel with the up slopes 22, 23 of the raising cam 11, respectively. On the inner side of a down slope 19 of the knitting cam 12, is provided a recess 25 that has a second down slope 24 that is parallel to the down slope 19. When said split knit presser 20 is in action (protruding), a selector jack butt 68, that will be described later, is pushed into the needle groove by the presser 20, and as a result, a needle jack butt 67 is also pushed into the needle groove. Hence the butt 67 does not contact the down slope 19 of the knitting cam 12 and moves straight ahead. When the needle jack butt 67 goes into the recess 25, the selector jack butt 68 will be released from the pressure of the presser 20 and will protrude to contact the second down slope 24 and descend. Above the knitting cams 12, 13 of the respective needle cam locks 6, 7, are provided center guide grooves 30, 31, approximately trapezoidal in shape, for guiding a slider butt 60. The center guide grooves 30, 31 are provided with guide surfaces 33, 34, respectively, with paths 32 directly connecting the former and the latter. The guide surfaces 33, 34 are lower than the guide grooves 30, 31 and are close to the guide cams 14 and are parallel with the center guide grooves 30, 31.

The center guide grooves are the deepest and reach the same level as the carriage base 35 on which cam locks 6, 7, 10 are mounted. The guide surfaces 33, 34 are a little higher than that and are at the half height. The height of the surface of the slider cam lock 10 is the full height that is the highest one. Left and right slopes 36, 37, that drop to the same height of the surface of the carriage base 35, are provided near both ends of the guide surfaces 33, 34.

The center guide grooves 30, 31 are connected by a connecting groove 38 that has the half height. By-pass grooves 39, 40 are connected from the center of the connecting groove 38 to the tops of the center guide grooves 30, 31, respectively. The by-pass grooves 39, 40 are provided with a ascending-leftward slope 41 and a ascending-rightward slope 42, respectively. In the by-pass grooves 39, 40, the slopes 41, 42 are of the same depth as the base 35, and other portions are of the half height.

Figure 2:
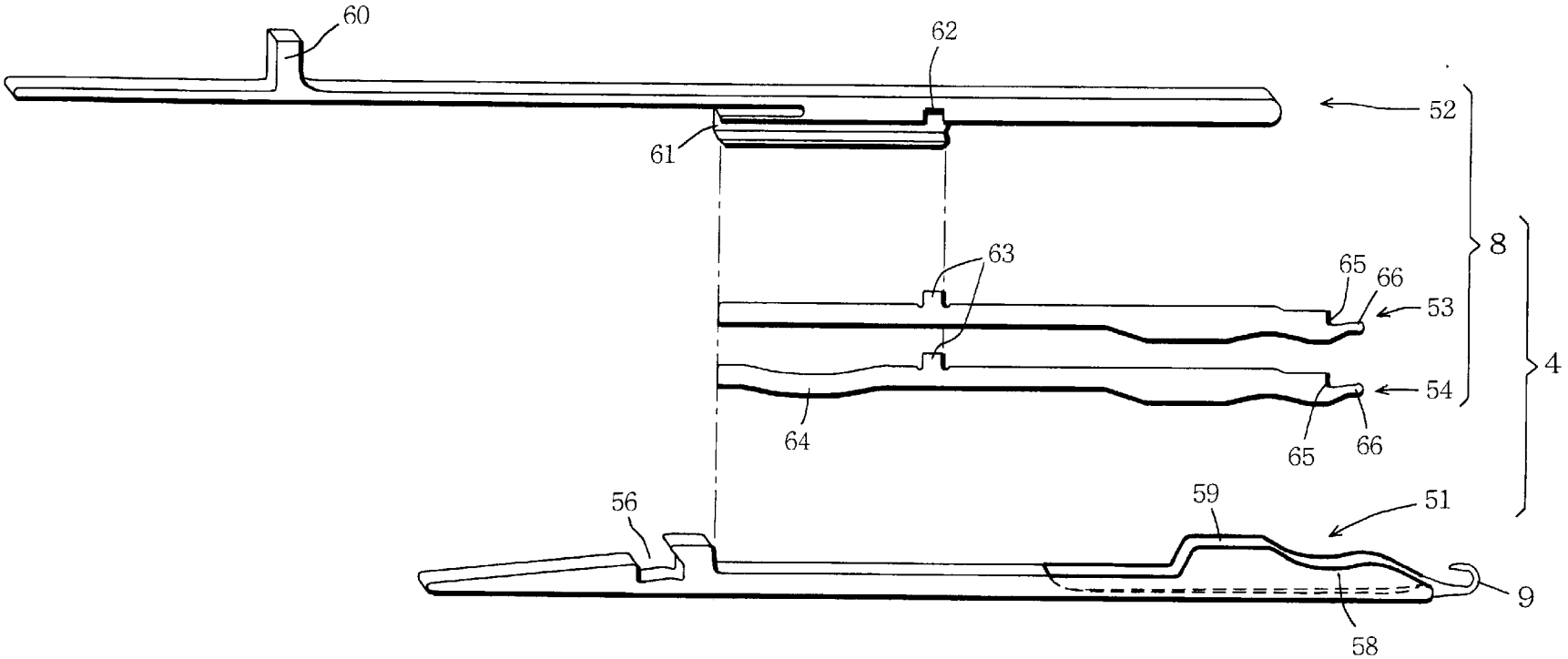

The needle 4 that is used in the knitting machine of the present invention will be described with reference to FIG. 2 through FIG. 4. The needle 4 is a compound needle comprising a needle proper 51 and a slider 8. The slider 8, in turn, comprises a slider body 52 and two elastic plates 53, 54. The needle proper 51 is provided with a recess 56 near the tail thereof, and the head of the needle jack 55 (illustrated in FIG. 1) is fit into the recess 56. A split groove 59 is formed in the needle proper 51, from the throat 58 at the root of the hook to the center of the needle proper. The slider body 52 is provided with a slider butt 60, that protrudes upward, near the tail thereof. It is also provided with a holding member 61 near the top end thereof. The holding member 61 has a [-shaped section and protrudes from the lower surface of the slider body 52. The elastic plates 53, 54 are substantially identical in configuration. They have a protrusion 63 at the center of the upper surface. The protrusion 63 fits into the recess 62 of the slider body 52. Two elastic plates 53, 54 are held by the holding member 61, with the protrusions 63 being fit in the recess 62.

There are two elastic plates 53, 54. On the tail of one elastic plate 54, is formed a doglegged bent 64. With this arrangement, when the compound needle 4 is inserted in the needle groove (not illustrated) of the needle bed, the compound needle 4 is pressed to contact the sides of the needle groove and will not be moved inadvertently. Steps 65 are formed at the top ends of the elastic plates 53, 54 to provide tongues 66. The top end portion of each tongue 66 is tilted a little upward to securely hold the yarn.

The protrusions 63 of the two elastic plates 53, 54 are fit into the recess 62 of the slider body 52, and the two elastic plates 53, 54 are supported by the holding member 61. Next, the two elastic plates 53, 54 are slidably fit into the split groove 59 of the needle proper 51 in such a way that the elastic plates 53, 54 can be moved up or down relative to the hook 9 of the needle proper 51 by the operation of the slider butt 60. When the elastic plates 53, 54 move up from below the hook 9 towards the hook 9, as shown in FIG. 4-B, the two elastic plates 53, 54 will be divided into two, and the tongues 66 will rise, pinching the hook 9.

The needle proper 51 is moved up or down by moving up or down the needle jack butt 67 (FIG. 1-B, FIG. 1-C) of the needle jack 55 being fit in the needle proper 51 by means of the needle cam locks, 6, 7, and by moving up or down the slider 60 relative to the hook 9 of the needle proper. 68 denotes a selector jack butt. The selector jack butt 68 of the selector 69, selected to be one of three positions A, H and B by a selector not illustrated, is subjected to the actions of the above-mentioned pressers 15, 17, 20.

As examples of the stitch forming method according to the present invention, the split knit method, the plating method, and the pile knitting method will be described on the basis of the actions of the compound needles 4F, 4B (hereinafter referred to as needles) of the front and back needle beds 3F, 3B and the actions of the needle cam locks 6, 7 and the slider cam lock 10, that are for controlling the needles, of the front and back carriages 5F, 5B. The carriages 5F, 5B shown in FIG. 1 are described by assuming that they travel from the right to the left.

Split Knit Method

A loop 70 that is related to the hook 9 of a front needle 4F of the front needle bed 3F, shown in FIG. 5, is to be split knitted. The outline of this split knit with the use of a carriage having two locks will be as follows: while the loop 70 is kept on tongues 66, the front needle 4F is raised and lowered by the preceding needle cam lock of the front carriage 5F. A yarn 72, received by the hook 9 of the front needle 4F, is pulled into the old loop 70 as a new loop 73, and the two new and old loops 73, 70 are supported by the front needle 4F. Next, the back needle 4B, raised by the succeeding needle cam lock 7 of the back carriage 5B, receives the old loop 70 of said two loops 73, 70. Then the back needle 4B is lowered by said cam lock 7. The old loop 70 is transferred onto the back needle 4B as a loop 70*b* (FIG. 11), and the two loops 73, 70*b* are held on the front and back needles 4F, 4B, respectively. Next, the carriage is reversed, and to transfer the loop 70*b*, held on the back needle 4B of the back needle bed 3B, onto the front needle 4F, the loop 70*b* is transferred from the front needle bed 3F onto the back needle bed 3B, then racking is made, and the loop 70*b* is transferred from the back needle bed 3B onto the front needle bed 3F (FIG. 31). These operations are effected through control of the front and back needles by means of the preceding needle cam lock of the front carriage or the back carriage, and of the succeeding needle cam lock of the back carriage or the front carriage. The split knit is completed by the above-mentioned operations.

A specific example will be described with reference to FIG. 30 through FIG. 32.

Figure 30:
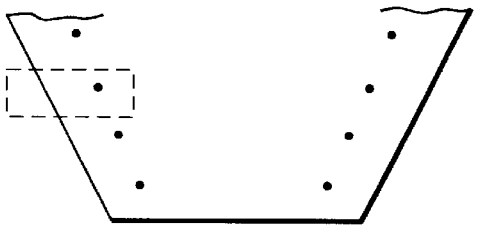
FIG. 30 is a schematic plan view of a fabric to be knitted by split knit, seen from above the trick gap.

FIG. 30 shows a fabric 78 to be internally increased. The rectangle of dashed line in the diagram schematically shows a part to be internally increased by one stitch. A through F of FIG. 31 show stitch knitting steps of the left edge of the fabric, and FIG. 32 is a structural diagram showing the relationship of the front and back needles and the split knit loop. Step A of FIG. 31 shows the state of loops held on the needle beds immediately before split knit, and all old loops 70 of a front course are held on needles b through z of the front needle bed 3F. In step B, yarn is fed to needles b through z to form new loops 73 of the next course, and a loop 70*b* is split knitted on the needle f of the back needle bed 3B. In step C, the new loops 73, that are held on the needles b through e of the front needle bed 3F, are transferred onto the needles b through e of the back needle bed 3B. In step D, the back needle bed 3B is racked to the left. In step E, said transferred loops 73 and the loop 70*b*, that was moved onto the needle 4B of the back needle bed 3B by split knit, are transferred onto the needles a through e of the front needle bed 3F. Next, in step F, the back needle bed 3B is racked to the right to complete the split knit by one stitch of the left edge of the fabric. Such a knitting is repeated to increase the knitting width to the desired one.

The details of actions of the front needle 4F and the back needle 4B (needles f of FIG. 31) that perform this split knit will be described with reference to FIG. 1 and FIG. 5 through FIG. 13. The marks 1 through 9 of FIG. 5 through FIG. 13 show phases in FIG. 1-A.

Before the operations by the carriages 5F, 5B, as shown in FIG. 5, the front needle 4F is lowered. At this point, as shown in FIG. 1, the selector 69 of the front needle 4F is selected to be in the position A (knit position) by an actuator that is not illustrated. Needle operation is first effected by the preceding cam lock 6 of the front carriage 5F. The needle jack butt 67 contacts the up slope 23 of the raising cam 11, and the slider butt 60 is in the lowest position (1 of FIG. 1-A). The hook 9 of the front needle 4F is in the position of the top of the front needle bed 3F, and the tongues 66 of the slider 8 are away from the hook 9 of the front needle 4F to open the hook 9 (FIG. 5).

Figure 6:
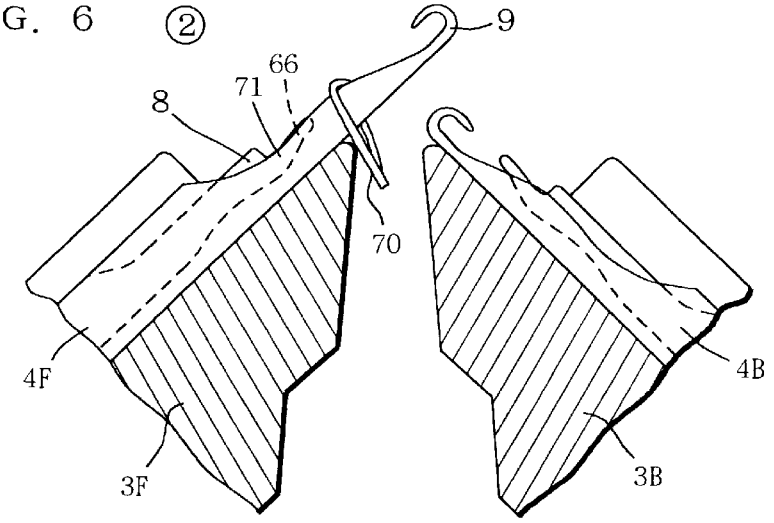
FIG. 6 is a sectional view in part of the both beds illustrating the needles in split knit when the hook of the needle of the front bed, holding the loop to be split, rises, and the slider rises to the throat of the needle of the front bed.

As the front and back carriages 5F, 5B travel to the left, the needle jack butt 67 rises on the up slope 23 of the raising cam 11 of the needle cam lock 6 of the front carriage 5F up to the shoulder position of the cam 11. On the other hand, the slider butt 60 rises on the slope 36 that follows the guide surface 33 of the slider cam lock 10. At this time, the above-mentioned needle jack butt 67 is rising on the up slope 23 of the raising cam 11, and the slider 8 is being pushed by the rise of the needle jack 55 (FIG. 4-D) to rise, and the slider butt 60 will get into the guide surface 33, having the half height, of the slider cam lock 10 (2 of FIG. 1-A). At this point of time, the throat 71 of the front needle 4F is near the top of the front needle bed 3F, and the tongues 66 of the slider 8 overlap with the throat 71 (FIG. 6).

Figure 7:
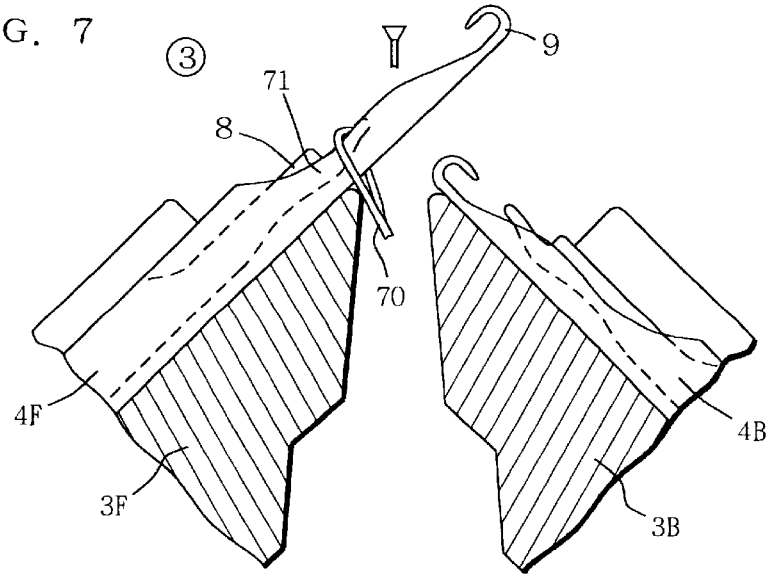
FIG. 7 is a sectional view in part of the front and back needle beds illustrating the motion of the needles in split knit when the hook of the needle of the front bed rises to the highest position, the slider also rises together with the hook, and the tongues of the slider hold the loop to be split.

Due to the travel of the carriages 5F, 5B to the left, the needle jack butt 67 will come to the protrusion 16 of the raising cam 11 of the preceding needle cam lock 6. At the time, the front needle 4F rises to the highest to take the knit position, and the slider butt 60, pushed by the rise of the needle jack 55, will go through the connecting pass 32 to drop into the center guide groove 30 (3 of FIG. 1-A). The loop 70 is at the throat 71 of the front needle 4F and is held on the tongues 66 of the slider 8 (FIG. 7).

As the carriages 5F, 5B travel to the left, the needle jack butt 67 is lowered by the guide cam 14. Conversely, the slider butt 60 is guided in the center guide cam 30 to rise a little and bring the tongues a little closer to the hook 9, and the hook 9 receives the yarn 72 from the yarn feeder 76 (FIG. 8). As the selector jack butt 68 has been selected for position A, it contacts the splitknit presser 20 and is pushed into the needle groove (FIG. 1-C). The needle jack butt 67 and the slider butt 60 are also in the needle groove. As a result, the needle jack butt 67 does not contact the down slope 19 of the knitting cam 12 and moves straight ahead, and the slider butt 60 moves from the deepest center guide groove 30 into the connecting groove 38 of the half depth. (4 of FIG. 1-A)

As the carriages 5F, 5B travel to the left, depression of the selector jack butt 68 by the split knit presser 20 will be undone. Then depression of the needle jack butt 67 by the presser 20 will be undone as well. The needle jack butt 67 protrudes into the recess 25 of the knitting cam 12 to contact the second down slope 24 to be lowered. The selector jack butt 68 is lowered by the jack guide cam 21, (loci of the butts 67, 68 are indicated by full lines in FIG. 1-A), to pass through the cam lock 6. The slider butt 60 holds its height in the connecting groove 38 (5 of FIG. 1-A). Due to the descent of the above-mentioned needle jack butt 67, the hook 9 will pull the yarn 72 into the loop 70 that is held on the tongues 66 to form a new loop 73. At this time, the hook 9 is lowered to separate the elastic plates 53, 54 of the slider 8, as shown in FIG. 4-C. The elastic plates 53, 54 open the top ends thereof (FIG. 4-B), and the loop 70 is held on the step 65 and tongues 66.

Although not illustrated in the diagrams, under the state between FIG. 8 and FIG. 9, while the hook 9 holds the yarn 72, the tongues 66 remain in the trick gap and hold the old loop 70. In this condition, a new loop 73 is not formed yet, and when the hook 9 is retracted from this condition a little further, the hook 9 will be closed to more reliably hold the yarn 72. When the hook 9 is retracted further, the yarn 72 will be pulled into the old yarn 70. From this condition, the hook 9 is retracted further to form the new loop 73, as shown in FIG. 9.

While the yarn 72 is pulled in, the old loop 70 is held on the step 65 and the tongues 66 of the slider, hence the new loop 73 is formed without being subjected to any large external forces such as friction between the old loop 70. This is important in knitting because it allows split knit of thin yarn or weak yarn that was difficult in the prior art. It also permits split knit of stitches of plural successive wales in the same course at a time. Thus the number of stitches can be increased by a large number at a time. This is applicable to, for example, knitting of the bottom edge of a pocket when a pocket is integrally knitted in a body.

As the carriage travels to the left, the needle jack butt 67 is raised a little by the jack guide cam 21, and the hook 9 of the front needle 4F is raised to a position corresponding to the top of the needle bed 3F (FIG. 10). As described above, the selector jack butt 68 is moved to the lowest position by the jack guide cam 21 and is in the position B. As a result, when the selector jack butt 68 enters into the succeeding lock 7, the butt 68 will be pressed into the needle groove by the fixed presser for suspension 15, and because of this, the butt 67 of the needle jack 55 will be pressed into the needle groove. The hook 9 of the front needle 4F will remain in the position shown in FIG. 10.

After that, the hook 9 of the front needle 4F does not move till the completion of split knit. On the other hand, with the travel of the carriages 5F, 5B to the left, the slider butt 60 drops from the preceding connecting groove 38 of the half depth into the deepest part of the by-pass groove 40, and the slider butt 60 is guided by the groove 40 to climb the slope 42 to the highest position, half depth, of the by-pass groove 40 (6 of FIG. 1-A). With regard to the needle 4B of the back needle bed 3B, before the entry into the succeeding cam lock 7 of the back carriage 5B, the selector jack butt 68 is selected for the position H by an actuator not illustrated, and the needle jack butt 67 is rising on the up slope 22 of the succeeding raising cam 11 of the back carriage 5B. And the slider butt 60 is in the lowest position (6 of FIG. 1-A). At the time, the loop 70, held on the tongues 66, is in such a position that when the needle 4B of the back needle bed 3B rises, the hook 9 thereof can be received into the loop 70 (FIG. 10).

Figure 11:
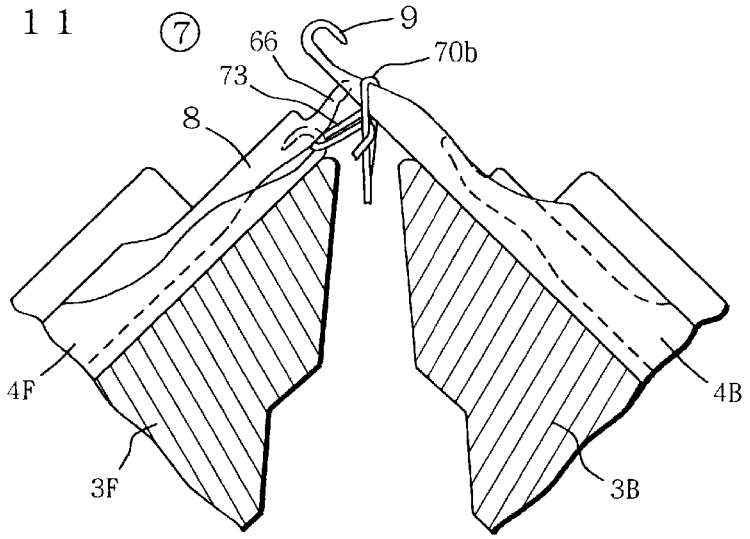
FIG. 11 is a sectional view in part of the front and back needle beds illustrating the motion of the needles in split knit, showing the state when the hook of the needle of the back bed is in the loop to be split, the slider of the needle of the front bed descends, and the loop to be split is held on the hook of the needle of the back bed.
Figure 12:
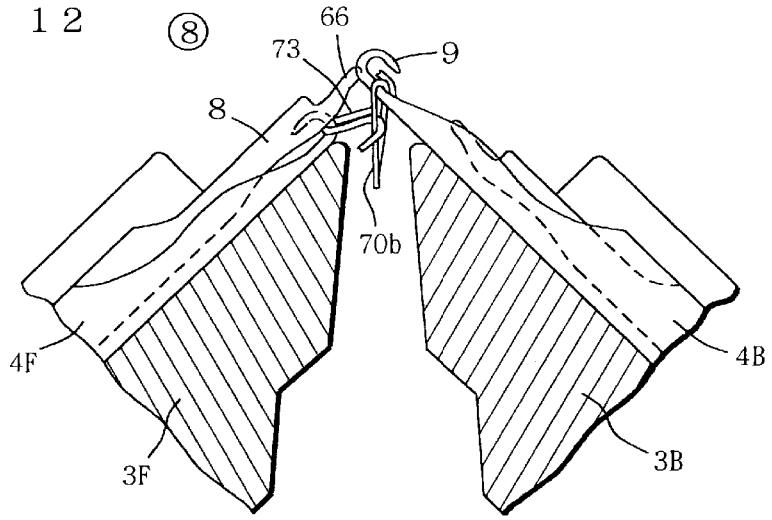
FIG. 12 is a sectional view in part of the front and back needle beds illustrating the motion of the needles in split knit, showing the state when the needle of the back needle bed starts to descend.

As the carriages 5F, 5B travel to the left, the needle jack butt 67 of the needle 4B of the back needle bed 3B will rise to the position of the shoulder of the raising cam 11 of the succeeding cam lock 7, and the needle 4B will insert its hook 9 into the loop 70 being held on the tongues 66 of the slider 8 of the front needle 4F. The loop 70 is held on steps 65 of the elastic plates 53, 54 of which top ends are open as shown in FIG. 4-B; thus the elastic plates 53, 54 and the loop 70 form a space that is triangular when seen from above. The hook 9 of the needle 4B of said back needle bed 3B is inserted into this space 75 (illustrated in FIG. 4-B), and as the hook 9 of the needle 4B is substantially on the center line of the loop 70 and is inserted into the loop 70 at the upper center of the trick gap 2, no strain will be generated in the loop 70. (FIG. 10, FIG. 11)

The slider butt 60, located in the highest position of the by-pass groove 40 of the succeeding needle cam lock 7 of the front carriage 5F, is guided by the by-pass groove 40 to descend and enter into the center guide groove 31 to, in turn, lower the slider 8 of the front needle 4F (7 of FIG. 1-A). By this descent of the tongues 66 of the front needle 4F, the loop 70 being held on the tongues 66 of the front needle 4F is transferred onto the hook 9 of the back needle 4B as a loop 70*b* that is formed by the split knit (FIG. 11). At this time, with the ascent of the needle jack butt 67, the slider butt 60 of the needle 4B enters from the slope 36 into the guide surface 34. And the selector jack butt 68 is pressed into the needle groove by the tuck presser 17.

As the carriages 5F, 5B travel to the left, the needle jack butt 67 jumps over the protrusion 16 of the raising cam 11, because the selector jack butt 68 is pushed in by the tuck presser 17. The needle jack butt 67 does not rise to the highest position, and is lowered by the knitting cam 13 (8 of FIG. 1-A, FIG. 2).

Figure 13:
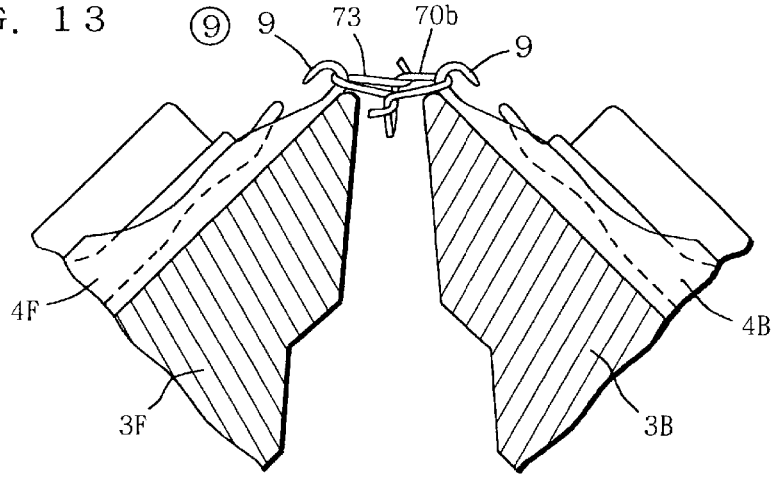
FIG. 13 is a sectional view in part of the front and back needle beds illustrating the motion of the needles in split knit, showing the state when the new loop and the old loop are held on the needle of the front bed and the needle of the back bed, respectively.

With further travel of the carriages 5F, 5B to the left, the needle jack butt 67 of the back needle 4B is lowered by the knitting cam 13 of the succeeding cam lock 7, and the slider butt 60, that was on the guide surface 34, is lowered through the slope 74 to the lowest position (9 of FIG. 1-A), and the loop 73 is held on the front needle 4F and the loop 70*b* is held on the needle 4B of the back needle bed 3B (FIG. 13, B of FIG. 31, FIG. 32). With the above-mentioned steps, one new loop is added to the back needle bed to complete split knit. In the case of split knit, in succession to the above-mentioned steps, knitting of steps C through F of FIG. 31 is made to increase the knitting width of the fabric.

Figure 29:
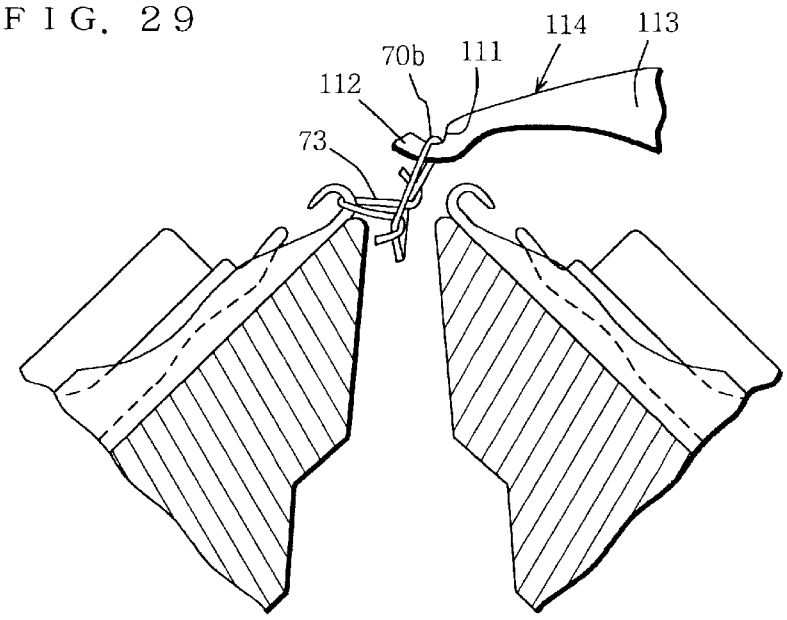
FIG. 29 is a longitudinal sectional view of the front and back needle beds of a modification wherein transfer jacks are provided above one of two needle beds opposing to each other.

In the above, receiving of stitch loops by an opposing front or back needle bed was described wherein a loop is held on tongues 6 of a compound needle 4 that is inserted in both front and back needle beds opposing head to head. However, as shown in FIG. 29, a transfer jack bed, not illustrated, may be provided above one needle bed 3F or 3B. This bed is provided with transfer jacks 114 and a loop 70 may be transferred onto one transfer jack 114 as a loop 70*b*. The transfer jack 114 is arranged, like the slider 8 of the compound needle 4, in such a way that two elastic plates 113 of an identical shape, having a step at the top end thereof to form a tongue 112, are overlapped with each other so that a hook 9 of a needle 4 can be inserted into the space between both elastic plates 114 at the tongues 112 thereof.

Plating Method

Plating uses two yarns to knit each course of the fabric. One yarn of these two yarns comes to the front of the fabric, and the other yarn comes to the back of the fabric. When these yarns have different colors, the front and back surfaces of the fabric have different shades.

In the present knitting method, a carriage of two locks is used, and if the carriage is assumed to travel to the left, the front yarn (white yarn) is knitted by the preceding needle cam lock, and the back yarn (black yarn) is knitted by the succeeding needle cam lock (each lock is for one side, front or back). With this arrangement, one course of plating can be knitted by a single stroke of the carriage. A course of plating may be knitted by two strokes of a carriage having one lock.

Figure 14:
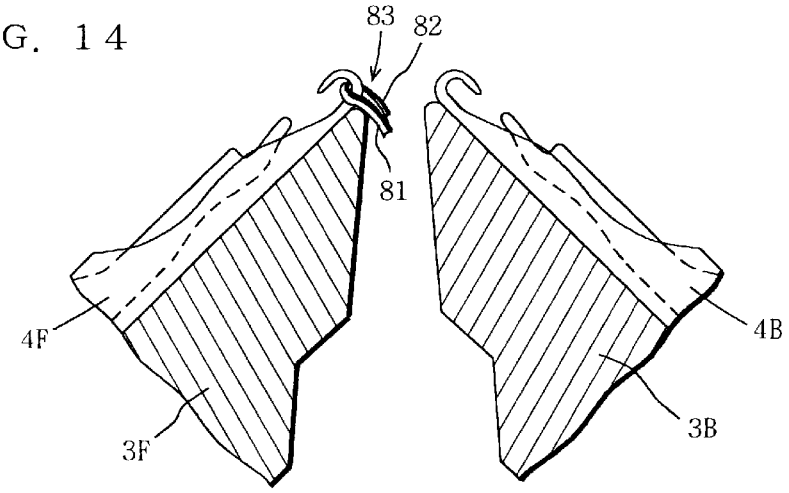
FIG. 14 is a sectional view in part of the front and back needle beds illustrating the motion of the needles in plating, showing the state when loops of a front course are held on the hook of a needle of the front needle bed.
Figure 15:
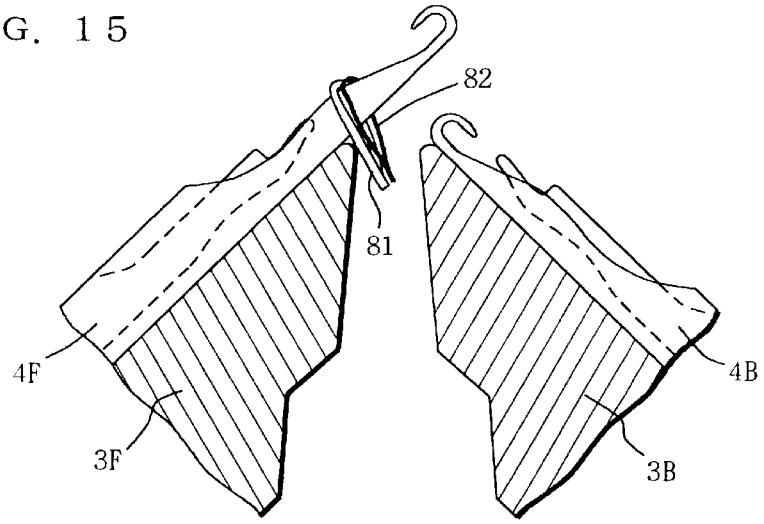
FIG. 15 is a sectional view in part of the front and back needle beds illustrating the motion of the needles in plating, showing the state when the needle of the front needle bed rises.

In an example shown in FIG. 14 through FIG. 21, front needles 4F are used, and each course of plain stitch is knitted in such a way that the white yarn appears on the front of the fabric, and the black yarn appears on the back of the fabric. In FIGS. 14, 81, 82 denote loops of a previous course that has been knitted (called the first course 83); 81 denotes a loop of the front yarn that is white, and 82 denotes a loop of the back yarn that is black. Both loops 81, 82 are aligned and held on the front needle 4F.

Figure 16:
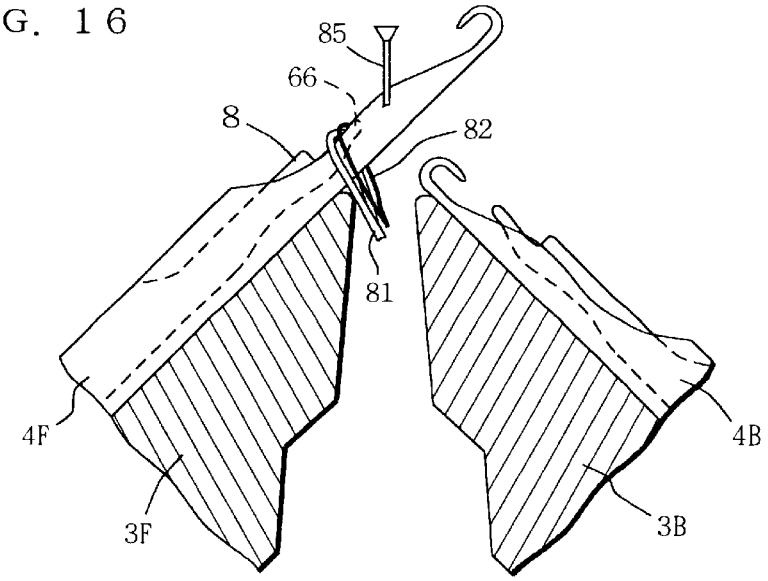
FIG. 16 is a sectional view in part of the front and back needle beds illustrating the motion of the needles in plating, showing the state when the front yarn of the next course is fed to the raised needle of the front bed.
Figure 17:
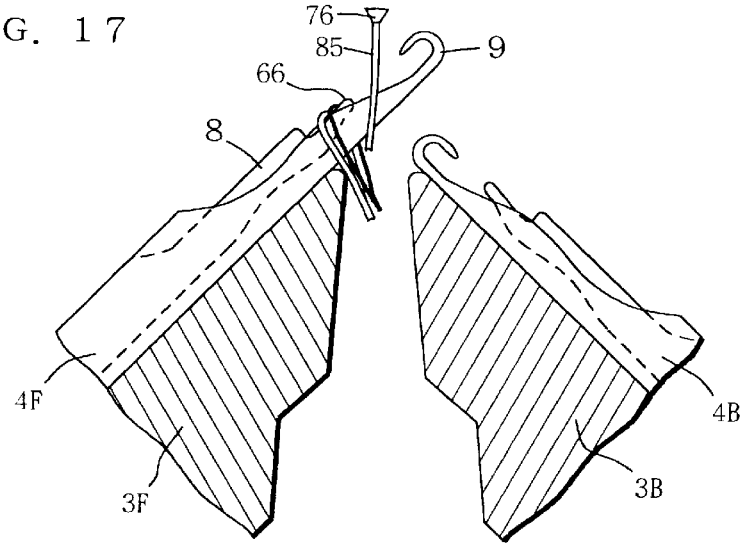
FIG. 17 is a sectional view in part of the front and back needle beds illustrating the motion of the needles in plating, showing the state when the hook of the needle of the front bed descends a little to catch the front yarn.
Figure 18:
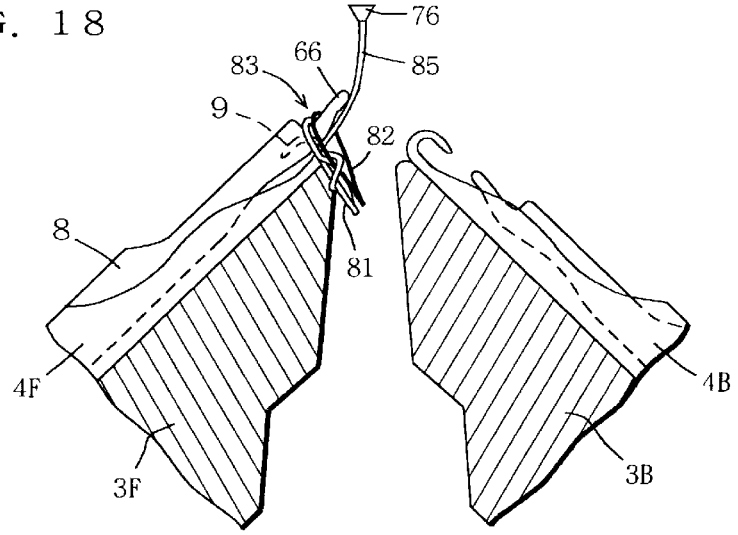
FIG. 18 is a sectional view in part of the front and back needle beds illustrating the motion of the needles in plating, showing the state when the hook of the needle of the front bed pulls the front yarn into the loop of the front course.
Figure 19:
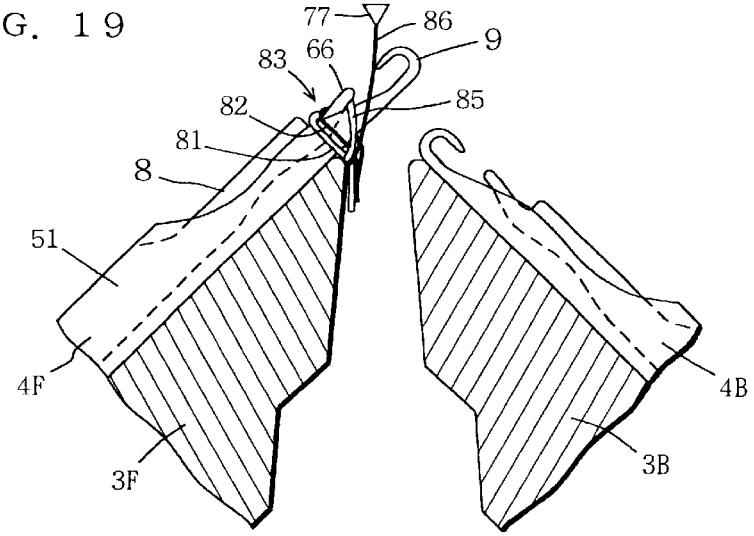
FIG. 19 is a sectional view in part of the front and back needle beds illustrating the motion of the needles in plating, showing the state when the hook of the needle of the front bed rises to the tuck position and the back yarn is fed to the needle.

To knit the second course 84 (FIG. 21), the needle 4F is raised (FIG. 15) and the front yarn 85 of the second course is fed to the needle 4F. The loops 81, 82 of the first course 83 are held on the tongues 66 of the slider 8 that has been raised together with the rise of the needle 4F to the knit position (FIG. 16). Next, the slider 8 stays in that position, and only the needle proper descends. In this step, while the loops 81, 82 of the first course 83 are held on the tongues 66 of the slider 8, the front yarn 85 from the yarn feeder 76 is hooked by the hook 9 of the needle 4F. Next, while the slider 8 stays in position, only the needle proper 8 is lowered, and the front yarn 85 of the second course is pulled into the loops 81, 82 of the first course 83 (FIG. 17, FIG. 18). Here, in FIG. 18, the front yarn 85 is pulled into the loops 81, 82. However, this is not essential. It is sufficient to hold the front yarn 85 by the hook 9.

Figure 20:
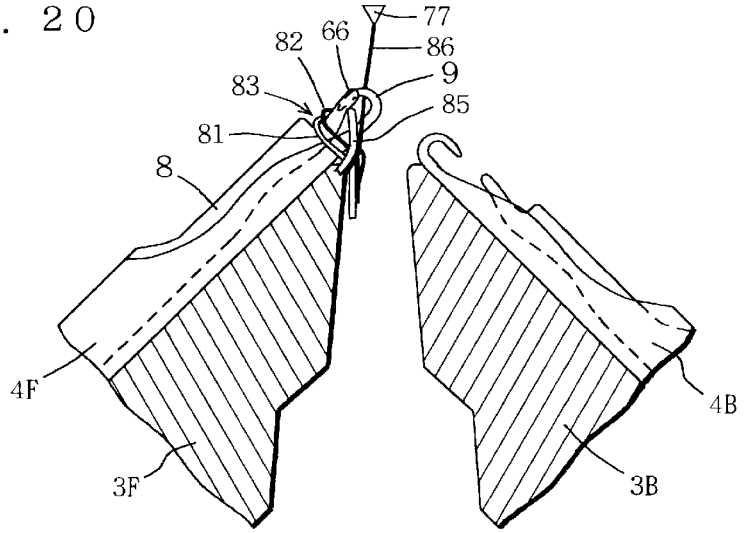
FIG. 20 is a sectional view in part of the front and back needle beds illustrating the motion of the needles in plating, showing the state when the hook of the needle of the front bed catches the back yarn and descends.
Figure 21:
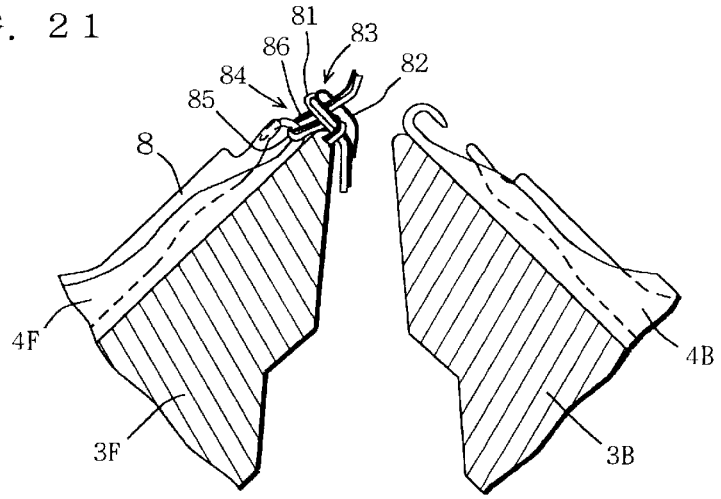
FIG. 21 is a sectional view in part of the front and back needle beds illustrating the motion of the needles in plating, showing the state when the needle of the front bed descends, aligns and pulls both the front and back yarns and pulls into the aligned loops of the front course.

Next, while the slider 8 is kept in position, the loops of the first course 83 are held on the tongues 66 and the front yarn 85 of the second course 84 are held on the hook 9, respectively, and only the needle proper 51 is raised to the tuck position. The reason for raising the needle proper 51 to the tuck position of FIG. 19 rather than to the knit position of FIG. 17 is that in the tuck position there is no fear of the front yarn 85 moving onto the tongues 66. What is important here is that the top end of the slider 8 is protruding into the hook 9. This prevents the front yarn 85 from overlapping with the loops 81, 82. The back yarn (black yarn) 86 for the second course 84 is fed from the yarn feeder 77 into the hook 9 (FIG. 19), and the needle proper 51 having both front and back yarns 85, 86 is lowered. The loops 81, 82 of the first course 83 are held on the tongues 66, and when the needle proper 51 is lowered, the hook 9 will contact the tongues 66 of the slider 8 and the hook 9 will be closed (FIG. 20). As the slider 8 and the needle proper 51 are lowered, the hook 9 will go through the loops 81, 82 of the first course 83 and form loops 85, 86 of the second course 84 in the loops of the first course 83 (FIG. 21). Then these steps are repeated.

Pile Knitting Method

To knit a pile fabric with the method according to the present invention, needles of front and back needle beds are used. In the method according to the present invention, a carriage having three locks, a preceding one, a middle one and a succeeding one, is used. If the carriage is assumed to travel to the left, the fastening yarn is knitted by the preceding lock's needle cam lock that works on the front needle side, and the pile yarn is knitted by the middle lock's needle cam locks that work on front and back needles. Removal of pile loops is effected by the succeeding lock's needle cam lock that works on the back needles.

Figure 22:
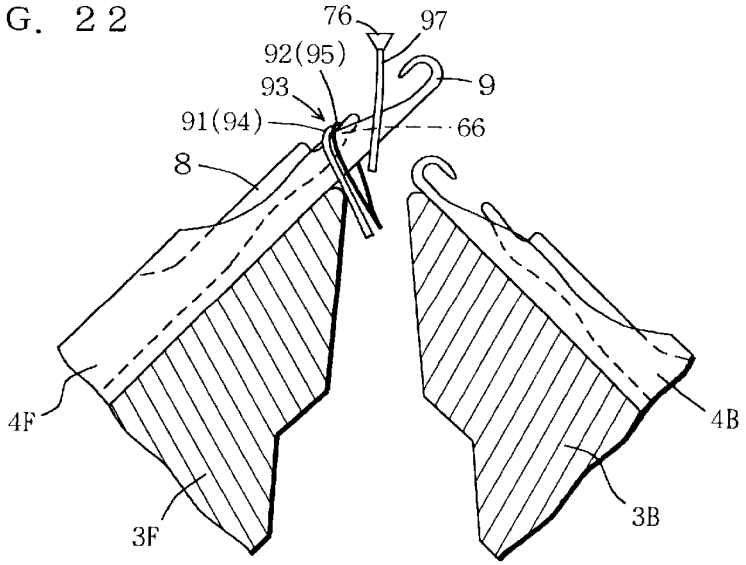
FIG. 22 is a sectional view in part of the front and back needle beds illustrating the motion of the needles in pile knitting, showing the state when a needle of the front bed, holding loops of a front course, catches a fastening yarn of the next course.

The details will be described in the following. First, the initial step of knitting is similar to that of the plating shown in FIG. 14 through FIG. 17 described above (the front yarn 81 of FIG. 17 is substituted by a fastening yarn 91 that will be described later). As shown in FIG. 22, aligned loops 94, 95 of the first course 93 are formed on the front needle 4F by using the fastening yarn 91 (white) and the pile yarn 92 (black), and the loops 94, 95 of the first course 93 are held on tongues 66 of the slider 8. Then the needle 4F is raised, and the clamping yarn 97 (white) of the second course 96 is fed to the hook 9 of the needle 4F.

Figure 23:
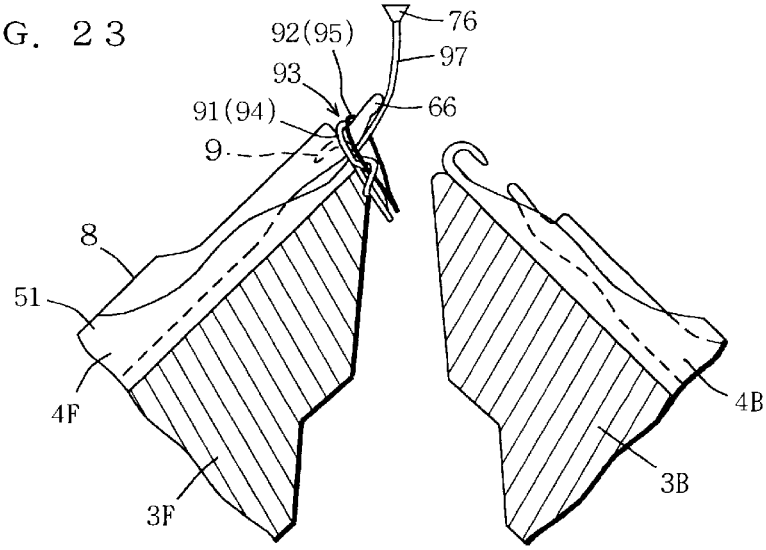
FIG. 23 is a sectional view in part of the front and back needle beds illustrating the motion of the needles in pile knitting, showing the state when the hook of the needle of the front bed pulls the fastening yarn into the loops of the front course being held on the raised slider of the needle of the front bed.

With regard to the needle 4F that received the yarn of the clamping yarn 97 of the second course, the slider 8 is kept in position, holding the loops 94, 95 of the first course 93, and only the needle proper 51 is lowered. The fastening yarn 97 of the second course is pulled into the loops 94, 95 of the first course by the hook 9. The pull-in by the hook 9 is controlled to be minimal. At the same time, the tongues 66 of the slider 8 are located in a position higher than the hook 9 to prevent loops 94, 95 of the first course 93 from being knocked over (FIG. 23).

Figure 24:
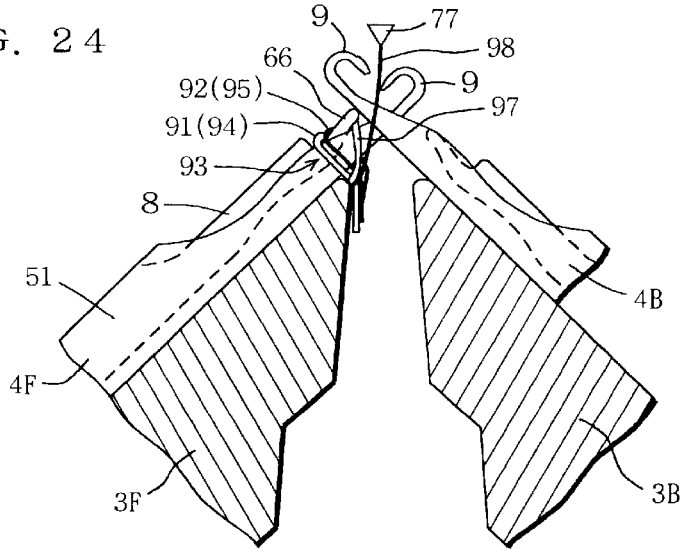
FIG. 24 is a sectional view in part of the front and back needle beds illustrating the motion of the needles in pile knitting, showing the state when the hook of the needle of the front bed rises to the tuck position, the needle of the back bed also rises, and the pile yarn is fed to these needles.
Figure 25:
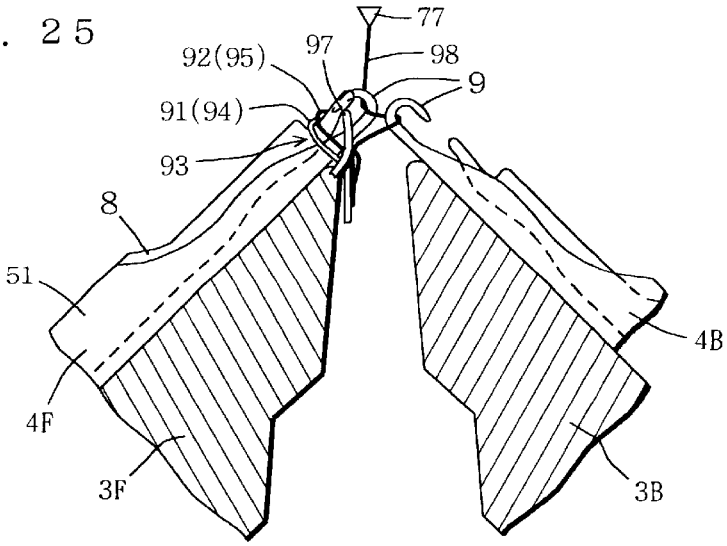
FIG. 25 is a sectional view in part of the front and back needle beds illustrating the motion of the needles in pile knitting, showing the state when both the needles of the front bed and the back bed descends to pull in the pile yarn.

Next, the pile yarn 98 of the second course 96 is fed. While the tongues 66 of the slider 8 being kept as described above, the front needle 4F is raised to the tuck position to hook the pile yarn 98 (black) that is fed to the needle. At the same time, the back needle 4B is raised to cross hooks 9, 9 with each other (FIG. 24). Next, both needles 4F, 4B are lowered (this is effected by the middle knitting cam). The back needle 4B is lowered, with only the pile yarn 98 (black) being held on the hook 9 thereof. And the front yarn 4F is lowered, holding both said pile yarn 98 (black) and the fastening yarn 91 (white) (FIG. 25). Next, the loop 99 of the fastening yarn 97 of the second course 96 and the loop 100 of the pile yarn 98 are pulled through the loops 94, 95 of the fastening yarn 91 and the pile yarn 92, respectively, of the first course 93 (FIG. 26).

Figure 26:
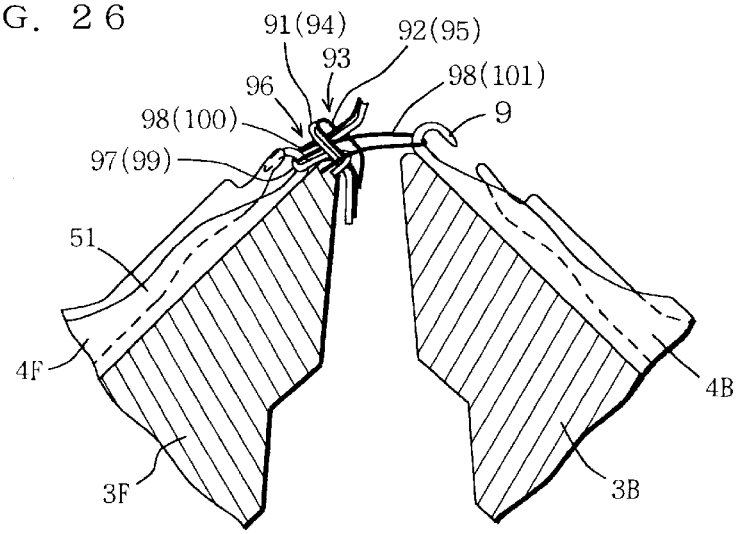
FIG. 26 is a sectional view in part of the front and back needle beds illustrating the motion of the needles in pile knitting, showing the state when the needle of the front bed pulls the aligned loops of the fastening yarn and the pile yarn into the aligned loops of the front course, and the needle of the back bed pulls down the pile of the pile yarn.
Figure 27:
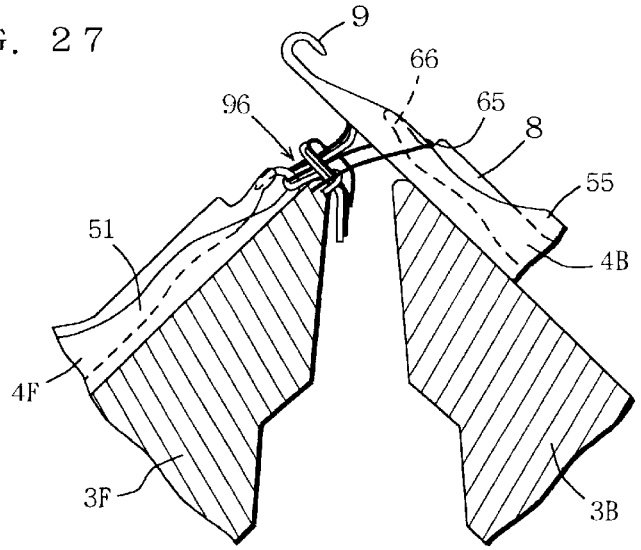
FIG. 27 is a sectional view in part of the front and back needle beds illustrating the motion of the needles in pile knitting, showing the state when the needle of the back bed rises and the pile yarn is held on the tongues of the needle of the back bed.
Figure 28:
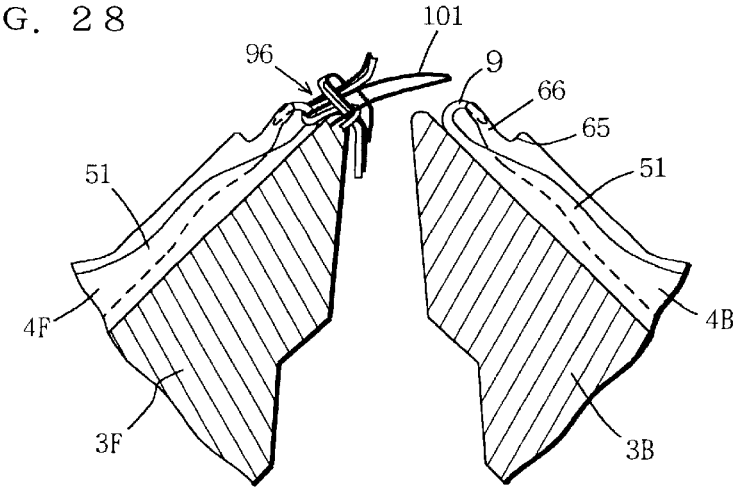
FIG. 28 is a sectional view in part of the front and back needle beds illustrating the motion of the needles in pile knitting, showing the state when the needle of the back bed descends and the pile yarn is removed from the needle of the back bed.

As a result, the pile yarn 98, using the front needle bed 3F, forms a loop or a stitch loop that is aligned with the fastening yarn 97, and the pile yarn 98 is held on the hook 9 of the back needle 4B and pulled out as pile 101 (FIG. 26). Next, the needle proper 51 and the hook 9 of the back needle bed 3B are raised by the needle cam lock 7 of the preceding lock of the back carriage (FIG. 27), and with said pile 101 being held on the steps 65 in the back of the tongues of the slider 8, the needle proper 51 is lowered and the hook 9 is closed by tongues 66. By lowering the needle with its hook closed, the pile 101 being held on the back needle 4B is removed (FIG. 28). A pile fabric is knitted by repeating the above-mentioned knitting.

FIG. 33 shows a modification of the cams of FIG. 1-A. Only additions or changes in the modification are denoted by new marks, and the same marks as FIG. 1-A are used for the rest. The leftward arrow in the top of FIG. 33 indicates the travel direction of the carriage. The upward arrow indicates the top of the diagram. 125 is a knitting cam of half height, 122 is a down slope, and 124 is a down slope of full height. When the selector jack butt 68 passes by on the presser 120 of half height, the needle jack butt 67 and the slider butt 60 do not contact any slope of half height. However, when the butt 67 and the butt 60 contact any slope of full height, they will be depressed at the position of contact. 1 through 9 of FIG. 33 correspond to 1 through 9 of FIG. 1-A and indicate actions of split knit. The relationship of the slider and the hook is as shown in FIG. 5 through FIG. 13.

In the embodiment, specific examples are indicated, but the present invention is not limited to them. For example, in the embodiment, the advanced position of the hook is specified to be the knit position or the tuck position, but the advanced position is not limited to these positions.

I claim:

1. A stitch forming method using a flat knitting machine wherein said machine includes at least a pair of needle beds, one in a front and an other in a rear, an area between said needle beds constituting a trick gap, each of the needle beds having a plurality of compound needles, each compound needle comprising a needle proper having a hook at a top end thereof and a slider having two elastic plates each having a tongue at a top end thereof, the needle proper and the slider being individually slidable forward to and backward from the trick gap, the tongues opening and closing the hook, and with advancement of the tongues beyond the hook, said two elastic plates being opened by said hook, and a yarn feeder to feed yarn to the hook of each said compound needle, said stitch forming method comprising:

advancing, to the trick gap, a hook and tongues of a first compound needle of said plurality of compound needles of a first needle bed of said pair of needle beds, said first compound needle holding at least one first stitch loop; and feeding a first yarn from the yarn feeder to the hook of the first compound needle, retracting said hook for holding said first yarn on the hook, and keeping said tongues in the trick gap for holding said first stitch loop on said tongues without knocking over the first stitch loop from the first compound needle.

2. A stitch forming method of claim 1 further comprising keeping said tongues in the trick gap and retracting further the hook of said first compound needle, forming at least a second stitch loop and holding the second stitch loop on the hook of the first compound needle.

3. A stitch forming method of claim 1 further comprising keeping said tongues in the trick gap and retracting further the hook of said first compound needle, forming at least a second stitch loop and holding the second stitch loop on the hook of the first compound needle;

advancing the tongues of the first compound needle to a position that a hook of a second compound needle of said plurality of compound needles of the second needle bed of said pair of needle beds can enter into said first stitch loop;

advancing the hook of the second compound needle and inserting the hook into the first stitch loop being held on the tongues of the first compound needle; and retracting the tongues of the first compound needle for holding said first stitch loop on the hook of the second compound needle.

4. A stitch forming method of claim 1 wherein at least on one side of said pair of front and back needle beds is provided a transfer jack bed having a plurality of transfer jacks, and said method further comprises keeping said tongues in the trick gap and retracting further the hook of said first compound needle, forming at least a second stitch loop and holding the second stitch loop on the hook of the first compound needle;

advancing the tongues of the first compound needle to a position that one transfer jack of the plurality of transfer jacks of the transfer jack bed can enter into said first stitch loop advancing said one transfer jack and inserting said one transfer jack into the first stitch loop being held on the tongues of the first compound needle; and retracting the tongues of the first compound needle for holding said first stitch loop on said one transfer jack.

5. A stitch forming method of claim 1 further comprising advancing again the hook of said first compound needle;

feeding a second yarn from the yarn feeder to the hook of the first compound needle, retracting said hook, pulling said second yarn into the first stitch loop and holding the first yarn and the second yarn on the hook of the first compound needle with the first yarn and the second yarn being aligned; and keeping said tongues in the trick gap and retracting further the hook of said first compound needle, forming at least a second stitch loop and holding the second stitch loop on the hook of the first compound needle.

6. A stitch forming method of claim 1 further comprising advancing the hook of said first compound needle and a hook of a second compound needle of said plurality of compound needles of the second needle bed of said pair of needle beds;

feeding a second yarn from the yarn feeder to the hook of the first compound needle and the hook of the second compound needle, retracting the hook of said first compound needle, pulling said second yarn into the first stitch loop, holding the first yarn and the second yarn on the hook of said first compound needle with the first yarn and the second yarn being aligned, and retracting the hook of said second compound needle to hold the second yarn on the hook of said second compound needle;

holding said tongues in the trick gap and retracting further the hook of said first compound needle, forming at least a second stitch loop and holding the second stitch loop on the hook of the first compound needle; and advancing the hook of said second compound needle, advancing the tongues of said second compound needle, holding said second yarn on the tongues of the second compound needle, retracting the hook and tongues of the second compound needle for removing the second yarn from the second compound needle.

7. A flat knitting machine comprising:

at least a pair of needle beds, one in a front and an other in a rear;

a trick gap between said needle beds;

a plurality of compound needles, each comprising a needle proper having a hook at a top end thereof and a slider having two elastic plates each having a tongue at a top end thereof, wherein each needle proper and each slider are individually slidable in the needle beds forward to and backward from the trick gap, each needle proper is provided with a needle proper butt, each slider is provided with a slider butt, the tongues are to open and close the hooks, and with the advancement of the tongue beyond the hook, said two elastic plates are opened by said book;

at least a yarn feeder for feeding a yarn to the hooks; and a carriage having a knitting lock comprising a needle cam lock and a slider cam lock provided on the trick gap side of the needle cam lock and working on slider butts for advancing and retracting the sliders, wherein said needle cam lock comprises a raising cam working on the needle proper butts for advancing hooks to the trick gap; and knitting cams arranged on both sides of the raising cam for retracting the hooks, and wherein said slider cam lock is provided with a first slider butt track engaging with the slider butts for keeping the tongues in a position beyond the hooks and making the slider butts pass through the knitting lock so that loops on the sliders are not knocked over during retracting the hooks from the trick gap and said slider cam lock guides said slider butts into a subsequent knitting lock.

8. A flat knitting machine of claim 7, wherein said carriage is provided with at least two of said knitting locks for each of said pair of front and back needle beds.

9. A flat knitting machine of claim 8, wherein between said knitting locks is provided a second slider butt track for advancing tongues holding a stitch loop to such a position that a hook of compound needle of the needle bed opposing to said tongues can be inserted into said stitch loop.

* * * * *